US007103922B1

(12) United States Patent
Doorley

(10) Patent No.: US 7,103,922 B1
(45) Date of Patent: Sep. 12, 2006

(54) HOSIERY HAVING A TOE NOTCH AND BUBBLE FOR ACCOMMODATING A SANDAL STRAP

(76) Inventor: Linda A Doorley, 3605 SW. 5th St., Cape Coral, FL (US) 33991

( * ) Notice: Subject to any disclaimer, the term of this patent is extended or adjusted under 35 U.S.C. 154(b) by 0 days.

(21) Appl. No.: 10/408,283

(22) Filed: Apr. 8, 2003

Related U.S. Application Data

(60) Provisional application No. 60/409,434, filed on Sep. 10, 2002.

(51) Int. Cl.
*A41B 11/00* (2006.01)

(52) U.S. Cl. ..... 2/409; 2/239

(58) Field of Classification Search ..... 2/239, 2/240, 241, 242, 409; 66/178 R, 185, 187; 36/11.5, 94, 88; 602/30; 112/475.12
See application file for complete search history.

(56) References Cited

U.S. PATENT DOCUMENTS

| | | | | | |
|---|---|---|---|---|---|
| 366,503 | A | * | 7/1887 | O'Neil | 36/140 |
| 482,095 | A | * | 9/1892 | McClurg | 66/187 |
| 1,452,302 | A | | 4/1923 | Loven | |
| D126,528 | S | | 4/1941 | Greenwald | |
| 2,422,736 | A | * | 6/1947 | Lambert | 2/241 |
| 2,932,829 | A | | 4/1960 | Corbin | |
| 3,013,564 | A | * | 12/1961 | Levey | 36/170 |
| 3,128,763 | A | * | 4/1964 | Langenfeld et al. | 128/894 |
| 3,967,390 | A | * | 7/1976 | Anfruns | 36/94 |
| 4,037,436 | A | * | 7/1977 | Wehrmann | 66/186 |
| 4,651,354 | A | * | 3/1987 | Petrey | 2/239 |
| 4,856,505 | A | * | 8/1989 | Shaffer et al. | 602/30 |
| 5,054,129 | A | * | 10/1991 | Baehr | 2/409 |
| 5,623,734 | A | * | 4/1997 | Pugliatti | 2/239 |
| D380,073 | S | | 6/1997 | Ruszczycki et al. | |
| 5,774,898 | A | * | 7/1998 | Malpee | 2/239 |
| 5,867,838 | A | | 2/1999 | Corry | |
| 5,878,442 | A | * | 3/1999 | Pejak | 2/409 |
| 5,906,007 | A | * | 5/1999 | Roberts | 2/239 |
| 6,000,247 | A | * | 12/1999 | Takeda et al. | 66/187 |
| 6,016,575 | A | * | 1/2000 | Prychak | 2/239 |
| 6,158,253 | A | * | 12/2000 | Svoboda et al. | 66/178 R |
| 6,226,800 | B1 | * | 5/2001 | Islar | 2/239 |
| D444,940 | S | | 7/2001 | Murrey | |
| 6,334,222 | B1 | * | 1/2002 | Sun | 2/239 |
| 6,367,087 | B1 | * | 4/2002 | Spillman et al. | 2/239 |

(Continued)

FOREIGN PATENT DOCUMENTS

| | | | |
|---|---|---|---|
| FR | 2235653 | * | 7/1975 |

*Primary Examiner*—Alissa L. Hoey
(74) *Attorney, Agent, or Firm*—Sughrue Mion, PLLC

(57) ABSTRACT

A hosiery item includes an upper part for covering the foot and at least a portion of the ankle of the wearer, and a lower part for covering the toes of the wearer. A toe notch is formed in the lower part to separate the lower part into a big toe accommodating pocket and a second pocket for accommodating the remaining toes. The toe notch has a depth such that in a relaxed, unstretched condition, the toe notch extends between the big toe and the second toe to a point between the first joint of the big toe and the crotch of the foot located between the big toe and the second toe. A thong-type sandal is received within the notch between the big toe and the second toe, and the inner end of the notch is pulled only slightly by the sandal strap against the crotch of the foot.

13 Claims, 2 Drawing Sheets

U.S. PATENT DOCUMENTS 6,381,755 B1 5/2002 Cortani
6,393,734 B1 * 5/2002 Ou ..... 36/97
6,415,448 B1 * 7/2002 Glogover ..... 2/239
2003/0074718 A1 * 4/2003 English ..... 2/239
2003/0145491 A1 * 8/2003 Udugama ..... 36/23

* cited by examiner

HOSIERY HAVING A TOE NOTCH AND BUBBLE FOR ACCOMMODATING A SANDAL STRAP

This application claims the benefit of U.S. Provisional Application No. 60/409,434, filed Sep. 10, 2002, under 35 U.S.C. § 119(e).

BACKGROUND OF THE INVENTION

1. Field of the Invention

The present invention relates to hosiery and more particularly, to a nylon stocking having a notch located between a big toe and a second toe for accommodating a strap of a thong-style sandal. The big toe slot is made of an expandable material that stretches as the big toe fits into the bubble.

2. Background of the Related Art

In the related art, certain types of sandals employ a strap or thong that fits between the big toe and the second toe of a foot of the wearer. However, it is a disadvantage of the related art that it is usually impractical to wear panty hose and other types of hosiery with such footwear, because the toe portion of the stocking interferes with the strap of the sandal.

To attempt to overcome the aforementioned related art problem, a wearer may force the strap of the sandal between the toes. However, this related art scheme also has various problems and disadvantages. For example, but not by way of limitation, a rather unattractive appearance is created and further, pressure and rubbing from the strap of the sandal can also prematurely damage the stocking.

In an attempt to overcome the aforementioned related art problem, Cortani (U.S. Pat. No. 6,381,755), the contents of which is incorporated herein, discloses notched toe panty hose, wherein each foot portion of the panty hose employs a slight recess or indent that accommodates the strap of a thong-style sandal. When such a sandal is put on over the panty hose, the strap of the sandal pulls the notch through the cleft between the big toe and second toe and against the crotch of those toes. This stretching of the notch is required in Cortani.

The notch of Cortani does not even reach the first joint of the big toe, as shown in FIG. 5 of Cortani. Additionally, as disclosed at column 2, lines 65–67, the notch of Cortani only extends to midway between the big toe 507 and the second toe 509.

However, the related art of Cortani also has various problems and disadvantages. For example, but not by way of limitation, undue pressure and wear are exerted against the sheer panty hose material. As a result, the related art hosiery is apt to rip or run.

Additionally, a notch that deep is apt to produce a stocking that fits too loosely about the toes and presents a rumpled and unattractive appearance. This is another disadvantage of the related art.

Accordingly, there is an unmet need in the related art to have a larger notch between the big toe portion and the second toe portion of the stocking to reduce sandal strap pressure exerted on the stocking. In distinction with the existing related art, the notch should not be so large that it extends fully to the crotch of the foot between the big toe and the second toe when the notch is in an unstretched condition.

It is an aspect of the invention to provide sheer, resilient hosiery for wearing with a thong type sandal and having an improved toe notch that is sufficiently deep to reduce the pressure otherwise exerted against the toe of the stocking by the sandal strap.

It is an aspect of the invention to provide hosiery that may be worn both comfortably and attractively with sandals having a strap that extends between the big toe and second toe.

It is an aspect of the invention to provide hosiery that may be worn with a thong-style sandal without experiencing undue wear, tear, runs and premature failure.

It is an aspect of the invention to provide hosiery that may be worn much more attractively with thong-type sandals than with the related art hosiery, and which does not bunch or bag about the toes when the footwear is put on over the hosiery.

This invention results from a realization that the toe notch in a pair of panty hose or similar hosiery functions better and resists damage more effectively if it includes a depth extending to between the first outermost joint of the big toe and the crotch of the big toe and second toe.

An embodiment of the invention comprises an embodiment that features an article of clothing for covering a foot and at least a portion of an ankle of a wearer, including a part for covering toes of the wearer. Also, a notch is provided for separating the part into a first pocket and a second pocket, wherein the notch has a depth such that when relaxed, the notch extends to a point between a first joint of a big toe and a crotch between the big toe and a second toe, and wherein a strap of a footwear received in the notch engages an inner end of the notch and only slightly pulls against the crotch.

Another embodiment of the invention comprises hosiery having a resilient upper portion that fits over the foot and at least part of the ankle of the wearer and a lower toe portion for engaging the wearer's toes. The toe portion includes a notch that separates the toe portion into a first, big toe accommodating pocket and a second pocket for accommodating the remaining toes. The first pocket is shorter than the second pocket, at least when the foot is removed from the hosiery. The notch has a depth such that when the hosiery is placed on the wearer's foot, the notch extends to between the first joint of the wearer's big toe and the crotch of the big toe and the second toe.

In another embodiment, the hosiery comprises a pair of nylon stockings in the form of panty hose and a toe notch as set forth above is provided in each foot portion. Alternatively, the hosiery may comprise ankle socks, knee-high or thigh-high stockings, leotards, tights and other forms of foot and leg wear. In most cases, the hosiery consists of a resilient synthetic material such as nylon. Alternatively, resilient natural materials may be employed. Reinforcement may be formed at the distal end of the big toe accommodating pocket and at the distal end of the second pocket, which accommodates the remaining toes. The first pocket may be more resilient than the second pocket.

BRIEF DESCRIPTION OF THE DRAWINGS

The accompanying drawings, which are included to provide a further understanding of embodiments of the present invention and are incorporated in and constitute a part of this specification, illustrate embodiments of the invention and together with the description serve to explain the principles of the drawings.

DETAILED DESCRIPTION OF THE INVENTION

Figure 1:
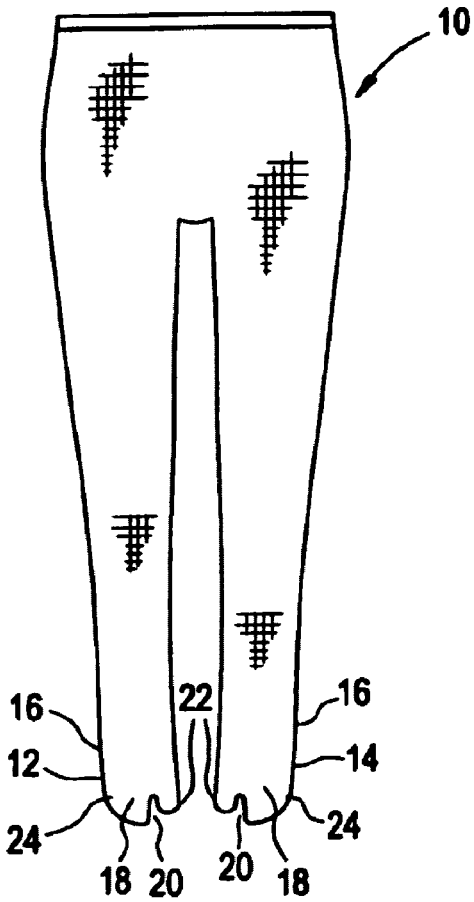
FIG. 1 is a front elevational view of a pair of panty hose with toe notches in each of the foot portions of the hose according to an exemplary, non-limiting embodiment of the present invention.

FIG. 1 illustrates an article of clothing, for example, a pair of nylon panty hose 10, with legs each having toe-notched foot portions 12 and 14 in accordance with an exemplary, non-limiting embodiment of this invention. The toe-notched foot portions 12, 14 may be employed in many other types of hosiery including (but not limited to) peds, ankle socks, knee high and thigh high stockings, tights and leotards.

The hosiery may be constructed from at least one of various types of natural and/or synthetic resilient material. Nylon is typically preferred, but the present invention is not limited thereto. The manner of manufacturing the hosiery should be well understood to persons skilled in the art, and does not comprise a part of this invention.

As shown in FIGS. 1–4, each of the foot portions 12, 14 includes an upper part 16 that engages the wearer's foot and at least part of the adjoining ankle. Also, a lower or distal part (i.e., section) 18 for covering the wearer's toes is connected to the upper part 16.

A toe notch 20 is formed in each toe section 18, such that the toe section is divided into a pair of toe accommodating pockets. More specifically, a bubble shaped first pocket 22 is designed to receive and accommodate the wearer's big toe BT. Also, notch 20 separates the first pocket 22 from a second pocket 24 that is designed for accommodating the user's four remaining toes (e.g., including second toe T2).

A reinforcement 26 that includes stitching or extra hosiery material is optionally formed along the distal edges of the first and second pockets 22, 24. The reinforcement is provided at a distal end of the first toe pocket 22 and/or the second toe pocket 24. The first pocket 22 can be more resilient than the second pocket 24.

Figure 2:
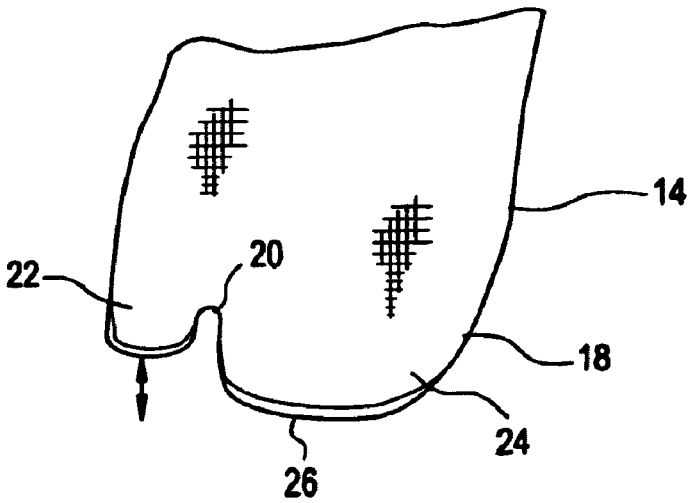
FIG. 2 is a fragmented, top plan view of the left foot side of the hose with the foot removed, according to an exemplary, non-limiting embodiment of the present invention.

FIG. 2 illustrates a view of the panty hose 10 with the foot removed, according to a non-limiting, preferred embodiment of the present invention. The first, big toe pocket 22 is usually slightly shorter than the second pocket 24 in a first direction extending from a heel portion to a toe portion of the panty hose 10. Further, the big toe pocket 22 is composed of a slightly more resilient material than the second pocket 24. This feature allows the bubble shaped first pocket 22 to expand to a greater extent than the second pocket 24 in the first direction when a foot is inserted into the hose, and comfortably accommodate the big toe BT of the wearer.

The notch 20 extends to a specific depth that has not been featured in the related art apparel of this type.

Figure 3:
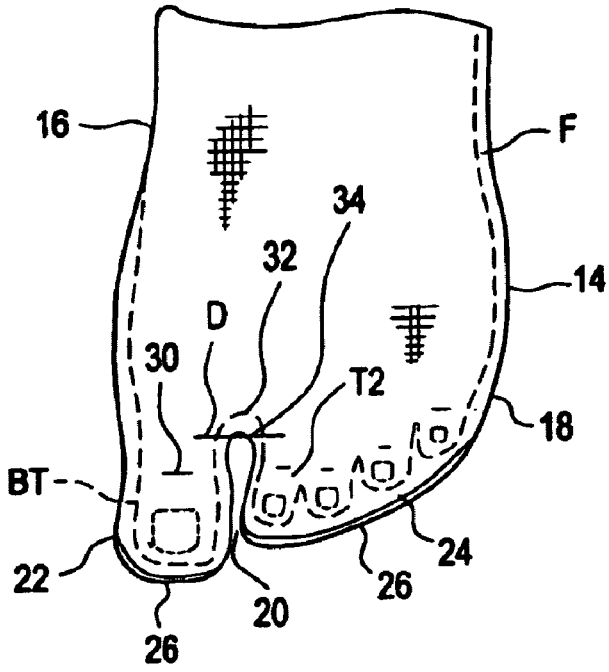
FIG. 3 is a fragmented, top plan view of the hosiery as worn on a wearer's left foot and particularly illustrating the position of the notch relative to the toes when no foot wear is being worn, according to an exemplary, non-limiting embodiment of the present invention.

FIG. 3 illustrates a view of the panty hose 10 with the foot inserted. In particular, the notch 20 has a depth such that when the hosiery is worn on the wearer's foot F, the notch 20 extends between the big toe BT and the second toe T2 to a depth located between the first joint 30 of big toe BT and the crotch 32 of the foot between the big toe BT and second toe T2. In other words, inner end 34 of notch 20 is positioned between the first joint 30 of the big toe and the crotch 32. At this point, the notch 20 is in its normal relaxed position.

FIG. 3 illustrates a view of an exemplary, non-limiting embodiment of the present invention, wherein the user has inserted their foot F into hosiery 10. When the hosiery 10 is put on, each of the foot portions 12, 14 is pulled over its respective foot. Big toe BT is inserted into the first pocket 20, which expands as shown in FIG. 3. The remaining toes, including second toe T2, are inserted into second pocket 24. As can be seen in a comparison between FIGS. 2 and 3, the first pocket 20 expands to a greater extent than the second pocket 24 when the big toe BT is inserted therein. The stockings present a neat and attractive appearance. The first pocket 22 fits snugly about, and assumes the shape of the big toe BT when the foot F is inserted. At the same time, the notch 20 is relaxed and in a natural state. The notch 20 is not stretched toward crotch 32.

Figure 4:
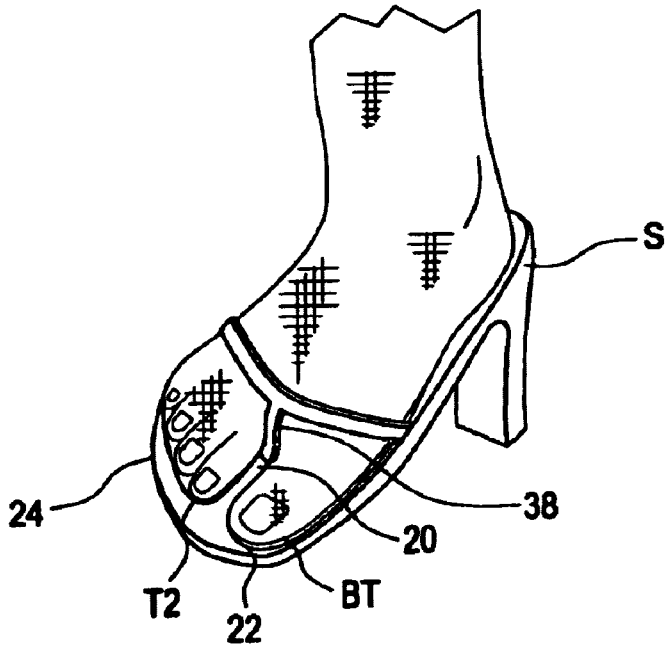
FIG. 4 is a fragmented, top plan view of the wearer's foot and notched hosiery inserted into a thong-type sandal, according to an exemplary, non-limiting embodiment of the present invention.

A thong-type sandal S is worn on each foot in the manner shown in FIG. 4. Sandal thong or strap 38 fits easily and comfortably between the cleft of big toe BT and second toe T2. Strap 38 slides easily into notch 20 and is received in the notch without putting undue pressure or stress against the inner end 34 (see FIG. 3) of the notch 20. Instead, the thong or strap 38 pushes against the inner end 34 only slightly, such that the inner end of the notch 20 barely engages the adjacent crotch 32 between toes BT and T2. The notch 20 is not substantially stretched toward the crotch 32. Because very little pressure is exerted against the nylon at the inner end of the notch 20, undue wear, rips, runs and premature hosiery failure are averted, which is an advantage of the present invention.

At the same time, the first and second toe pockets 22, 24 are held against the toes in a neat, smooth and attractive manner. Bunching and bagging of the toe pockets is avoided because the toes pull the pockets outward rather than the strap 38 pulling the notch 20 inward. The strap 38 does not substantially pull the notch 20 inward. The user is thereby allowed to wear a wide variety of hosiery items in an attractive and comfortable manner.

The present invention may be used successfully with assorted sandals, high and low heel shoes, and other types of footwear employing a strap designed to be inserted between the big toe BT and the second toe T2. It is another advantage of the present invention that the reinforcing material 26 reduces wear at the distal ends of the toes. Such wear is further reduced because the strap 38 does not pull the toe end of the stocking rearwardly against the tips of the toes.

This is an important distinction from the related art, and enables the hosiery of this invention to be much more durable while providing a neater and more attractive appearance than the related art sandal hosiery. The color of first pocket 22 matches the remainder of the product to present a uniform, attractive appearance. The hosiery of this invention satisfies most current dress codes for work in as much as the wearer's entire foot F is covered uniformly by the same type of stocking material.

From the foregoing, it may be seen that the apparatus of this invention provides for hosiery and more particularly, nylon stockings having a notch located between the big toe and second toe for accommodating the strap a thong-style sandal. While this detailed description has set forth particularly preferred embodiments of the apparatus of this invention, numerous modifications and variations of the structure of this invention, all within the scope of the invention, will readily occur to those skilled in the art. Accordingly, it is understood that this description is illustrative only of the principles of the invention and is not limiting thereof.

Although specific features of the invention are shown in some of the drawings and not others, this is for convenience only, as each feature may be combined with any and all of the other features in accordance with this invention.

What is claimed is:

1. An article of clothing for covering a foot and at least a portion of an ankle of a wearer, comprising:

a part for covering toes of the wearer; and a notch separating the part into a first pocket accommodating the wearer's big toe and a second pocket accommodating at least the wearer's second toe, wherein:

the notch has a depth such that, when relaxed, the notch extends to a point between a first joint of the wearer's big toe and a crotch between the big toe and the wearer's second toe;

the resiliency of the material comprising the first pocket is greater than the resiliency of the material comprising the second pocket;

the first pocket is shorter in a first direction than the second pocket when the wearer's toes are not placed in the part;

the first pocket expands to a greater extent, in the first direction, than the second pocket when the wearer's toes are placed in the part; and the first direction extends from a heel portion to the part of the article of clothing.

2. The article of clothing of claim 1, wherein the article of clothing comprises hosiery having said toe notch in said part formed in each foot portion of said hosiery.

3. The article of clothing of claim 2, wherein the hosiery comprises a nylon stocking.

4. The article of clothing of claim 3, wherein the nylon stocking comprises panty hose.

5. The article of clothing of claim 1, wherein at least a portion of the article of clothing is made of a resilient synthetic material.

6. The article of clothing of claim 5, wherein the resilient synthetic material is nylon.

7. The article of clothing of claim 1, wherein the article of clothing is made of a resilient natural material.

8. The article of clothing of claim 1, further comprising a reinforcement at one of a distal end of the first pocket and a distal end of the second pocket.

9. The article of clothing of claim 8, wherein the reinforcement comprises one of stitching or extra clothing material formed along the distal edge of the first pocket and the distal edge of the second pocket.

10. The article of clothing of claim 1, wherein said first pocket is substantially bubble shaped, and receives and accommodates the big toe.

11. The article of clothing of claim 1, wherein when the article of clothing is engaged with the foot of the wearer, said part is pulled over the foot, the big toe expands the first pocket to assume the shape of the big toe, and the remaining toes are inserted into the second pocket.

12. The article of clothing of claim 1, wherein:

a strap of a footwear, when received in the notch, engages an inner end of the notch and only slightly pulls against the inner end of the notch; and the footwear comprises at least one of a thong-type sandal, high heel shoe, low heel shoe, and footwear employing a strap inserted between the big toe and the second toe.

13. The article of clothing of claim 1, wherein the color of first pocket matches a color of the article of clothing.

* * * * *